US006438994B1

(12) United States Patent
Rashad et al.

(10) Patent No.: US 6,438,994 B1
(45) Date of Patent: Aug. 27, 2002

(54) METHOD FOR PROVIDING REFRIGERATION USING A TURBOEXPANDER CYCLE

(75) Inventors: Mohammad Abdul-Aziz Rashad, Kenmore; Kenneth Kai Wong, Amherst; Henry Edward Howard, Grand Island; Dante Patrick Bonaquist, Grand Island; Bayram Arman, Grand Island, all of NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 09/963,450

(22) Filed: Sep. 27, 2001

(51) Int. Cl.[7] ..... F25J 1/00
(52) U.S. Cl. ..... 62/613; 62/86; 62/619
(58) Field of Search ..... 62/86, 87, 88, 62/613, 619

(56) References Cited

U.S. PATENT DOCUMENTS

| | | | | |
|---|---|---|---|---|
| 5,207,066 A | * | 5/1993 | Bova et al. | 62/924 |
| 5,483,806 A | | 1/1996 | Miller et al. | 62/402 |
| 5,524,442 A | | 6/1996 | Bergman, Jr. et al. | 62/86 |
| 6,041,620 A | | 3/2000 | Olszewski et al. | 62/612 |
| 6,041,621 A | | 3/2000 | Olszewski et al. | 62/613 |
| 6,065,305 A | | 5/2000 | Arman et al. | 62/613 |
| 6,076,372 A | | 6/2000 | Acharya et al. | 62/606 |
| 6,105,388 A | | 8/2000 | Acharya et al. | 62/612 |
| 6,176,102 B1 | | 1/2001 | Novak et al. | 62/612 |
| 6,250,096 B1 | | 6/2001 | Bonaquist et al. | 62/401 |

* cited by examiner

*Primary Examiner*—Ronald Capossela
(74) *Attorney, Agent, or Firm*—Stanley Ktorides

(57) ABSTRACT

A method for generating refrigeration using a turboexpander or reverse Brayton cycle which can more efficiently generate refrigeration especially to cryogenic temperatures using a defined refrigerant mixture containing argon and/or nitrogen.

18 Claims, 4 Drawing Sheets

METHOD FOR PROVIDING REFRIGERATION USING A TURBOEXPANDER CYCLE

TECHNICAL FIELD

This invention relates to the generation and provision of refrigeration using a turboexpander or reverse Brayton cycle and is especially useful for generating refrigeration at cryogenic temperatures as low as −250 F.

BACKGROUND ART

Generally cascade type vapor compression refrigeration cycles, which employ Joule-Thomson valve expansion of a gas to generate refrigeration, are used to provide low temperature refrigeration such as from −60 F. to −150 F. Typically such vapor compression refrigeration cycles use ozone depleting refrigerants or hazardous refrigerants such as propane or ammonia.

Turboexpander cycles, also known as reverse Brayton cycles, have also been used to supply low temperature refrigeration. Turboexpander cycles are advantageous over cascade type vapor compression cycles in that they are more compact and more reliable than comparable cascade systems which require two or more refrigeration loops, and are also less sensitive to operation away from the design point than are cascade vapor compression cycles. Unfortunately turboexpander refrigeration cycles are limited in their ability to approach the efficiency of such conventional cascade type vapor compression refrigeration cycles.

Accordingly, it is an object of this invention to provide an improved method for providing refrigeration using a turboexpander or reverse Brayton refrigeration cycle.

SUMMARY OF THE INVENTION

The above and other objects, which will become apparent to those skilled in the art upon a reading of this disclosure, are attained by the present invention one aspect of which is:

A method for producing refrigeration employing a turboexpander cycle comprising:

(A) compressing a refrigerant mixture comprising at least one component from the group consisting of argon and nitrogen, and at least one component having a normal boiling point within the range of from −100 F. to −260 F.;

(B) cooling the compressed refrigerant mixture;

(C) turboexpanding the cooled compressed refrigerant mixture to provide a two phase turboexpanded refrigerant mixture; and (D) warming the turboexpanded refrigerant mixture to provide refrigeration to a heat load.

Another aspect of the invention is:

A method for producing refrigeration employing a turboexpander cycle comprising:

(A) compressing a refrigerant mixture comprising at least one component from the group consisting of argon and nitrogen, and at least one component from the group consisting of helium and neon;

(B) cooling the compressed refrigerant mixture;

(C) turboexpanding the cooled compressed refrigerant mixture to provide a two phase turboexpanded refrigerant mixture; and (D) warming the turboexpanded refrigerant mixture to provide refrigeration to a heat load.

As used herein the term "indirect heat exchange" means the bringing of two fluids into heat exchange relation without physical contact or intermixing of the fluids with each other.

As used herein the term "normal boiling point" means the temperature at atmospheric pressure at which a fluid changes from liquid to a gas.

As used herein the term "turboexpander" means a mechanical device which converts the pressure energy of a fluid into rotational energy. The expanded fluid experiences a reduction in temperature. The rotational energy could be used to drive a compressor wheel or to produce electrical energy.

As used herein the term "turboexpansion" means the process of allowing a gas to expand through a turboexpander thus experiencing a reduction in temperature and producing useful work. The expansion of the gas is ideally isentropic.

BRIEF DESCRIPTON OF THE DRAWING

DETAILED DESCRIPTION

The invention comprises the use of a refrigerant mixture comprising at least one component from the group consisting of argon and nitrogen and at least one component having a normal boiling point within the range of from −100 F. to −260 F. Preferably the argon and/or nitrogen is present in the refrigerant mixture in a concentration of from 10 to 95 mole percent, more typically in a concentration of from 10 to 75 mole percent. The component or components having a normal boiling point within the range of from −100 F. to −260 F. is present in the refrigerant mixture in a concentration of up to 90 mole percent and preferably in a concentration of not more than 40 mole percent.

Components having a normal boiling point within the range of from −100 F. to −260 F. include methane, tetrafluoromethane, ethylene, nitrous oxide, ethane, trifluoromethane, carbon dioxide and hexafluoroethane.

The refrigerant mixture employed in the method of this invention may also include up to 25 mole percent of one or more components which have a normal boiling point greater than −100 F. up to −20 F. Among such components one can name bromotrifluoromethane, difluoromethane, pentafluoroethane, propylene, 1,1,1-trifluoroethane, propane, octofluoropropane, ammonia and cyclopropane.

The refrigerant mixture employed in the method of this invention may also include up to 15 mole percent of one or more components which have a normal boiling point greater than −20 F. up to 100 F. Among such components one can name 1,1,1,2-tetrafluoroethane, difluoroethane, dimethylether, 1,1,2,2-tetrafluoroethane, 1,1,1,2,2-pentafluoropropane, 1,1,1,2,3,3,3-heptafluoropropane, isobutane, sulfur dioxide, methylamine, octofluorocyclobutane, n-butane, 1,1,2-trifluoroethane, 1,1,1,2,3,3-hexafluoropropane, pentafluoropropane, ethylamine, isopentane, dichlorotrifluoroethane, methoxyperfluoropropane, ethylether, and n-pentane.

Figure 1:
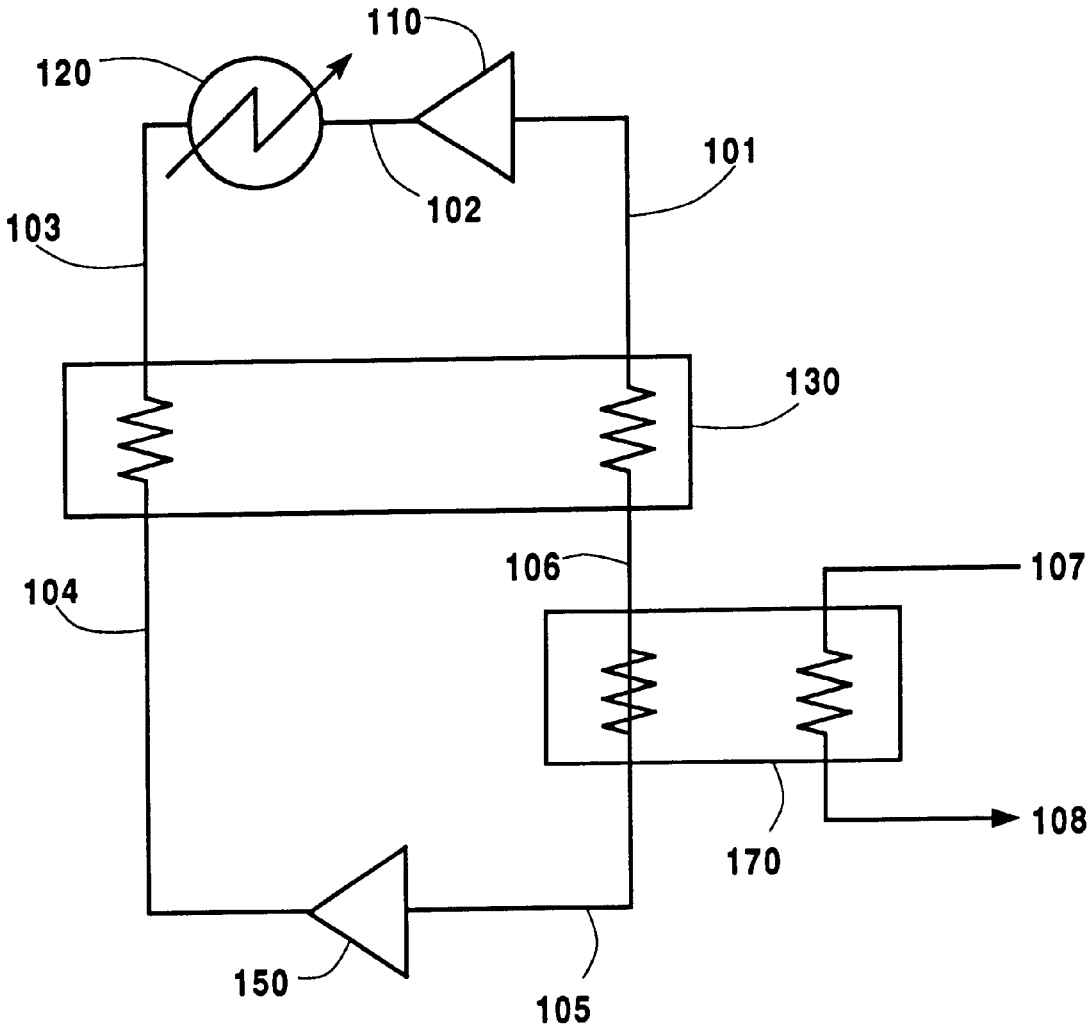
FIG. 1 is a schematic representation of one preferred embodiment of the turboexpander cycle refrigeration method of this invention.

The invention will be described in greater detail with reference to the Drawings. Referring now to FIG. 1, refrigerant mixture 101, generally at a pressure within the range of from 100 to 1200 pounds per square inch absolute (psia), is compressed by passage through compressor 110 to a pressure generally within the range of from 150 to 2500 psia. Resulting compressed refrigerant mixture 102 is cooled of the heat of compression by passage through aftercooler 120 and then passed in stream 103 to auto-refrigerator heat exchanger 130 wherein it is cooled by indirect heat exchange with recirculating refrigerant mixture as will be more fully described below. Cooled compressed refrigerant mixture 104 may be all vapor or may have a small liquid portion. Cooled compressed refrigerant mixture 104 from auto-refrigerator heat exchanger 130 is passed to turboexpander 150 wherein it is turboexpanded to a pressure generally within the range of from 100 to 1200 psia and thereby generating refrigeration. The turboexpanded refrigeration bearing refrigerant mixture 105 emerges from turboexpander 150 in two phases, i.e. as both vapor and liquid. Typically the liquid portion of the turboexpanded refrigerant mixture will be up to 10 percent of the turboexpanded refrigerant mixture by mass.

It is an important aspect of this invention that the turboexpanded refrigerant mixture be in two phases. A two phase exit from the turboexpander enables the achievement of higher net refrigeration effect per pound of refrigerant because there is a latent heat component in boiling the liquid portion of the refrigerant. Moreover, given a desired refrigeration temperature, warm end cooling efficiency can be optimized by including higher heat capacity/density components in the refrigerant which would form a liquid phase upon turboexpansion to the desired temperature. Furthermore, it is believed that entering the two phase region, there is a higher dT/dP gradient and hence a lower temperature can be achieved for a lower pressure ratio across the turboexpander.

Two phase turboexpanded refrigerant mixture 105 is passed to load heat exchanger 170 wherein it is warmed by indirect heat exchange with a heat load, shown in FIG. 1 as fluid stream 107 entering load heat exchanger 170. The resulting refrigerated fluid stream 108 exits load heat exchanger 170. Refrigeration bearing fluid 108 may, for example, be the atmosphere of a food freezer or may be used to cool the atmosphere of a food freezer wherein food is frozen and/or maintained in a frozen condition. Indeed the load heat exchanger may itself be a food freezer. Other applications of refrigeration bearing fluid stream 108 include cooling of low temperature reactors, production of dry ice, tire grinding, vent gas condensation, production of liquefied natural gas, and cryocoolers down to −452° F. The refrigeration could be supplied just at the cold end, as is shown in the Drawings, or the load stream could be cooled from ambient down to a desired cold temperature as in a liquefier.

As the turboexpanded refrigerant mixture is warmed to provide refrigeration to the heat load, some or all of the liquid portion is vaporized. Warmed refrigerant mixture exits load heat exchanger 170 in stream 106 and is passed to auto-refrigerator heat exchanger 130 wherein it is further warmed, and any remaining liquid is vaporized, by indirect heat exchange with the previously described cooling compressed refrigerant mixture 103. The further warmed refrigerant mixture exits auto-refrigerator heat exchanger 130 as stream 101 for passage to compressor 110 and the turboexpander refrigeration cycle starts anew.

Figure 2:
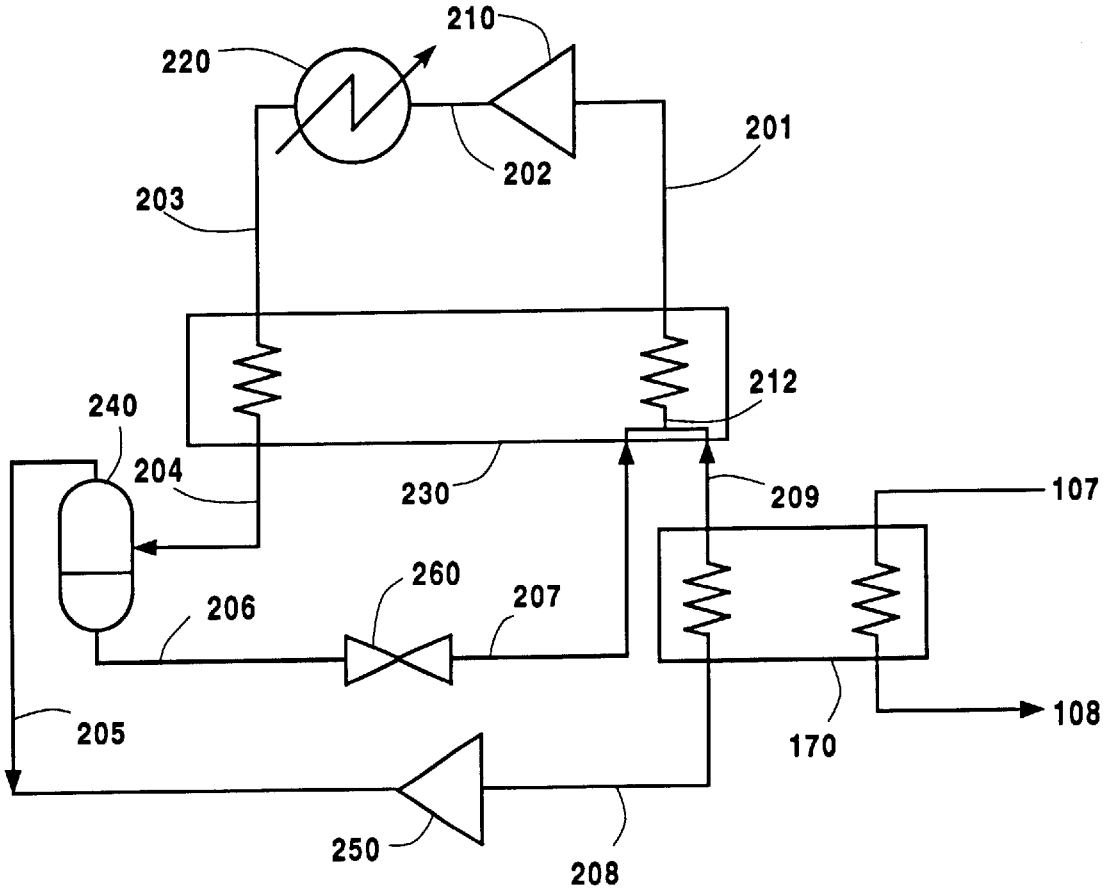
FIG. 2 is a schematic representation of another preferred embodiment of the turboexpander cycle refrigeration method of this invention wherein the refrigerant mixture undergoes a phase separation prior to turboexpansion.

FIG. 2 illustrates another embodiment of the invention which is particularly useful with a refrigerant mixture which contains one or more higher boiling components. The numerals of FIG. 2 correspond to those of FIG. 1 for the common elements and a description of such common elements will not be repeated.

Referring now to FIG. 2, refrigerant mixture 201, generally at a pressure within the range of from 100 to 1200 psia, is compressed by passage through compressor 210 to a pressure generally within the range of from 150 to 2500 psia. Resulting compressed refrigerant mixture 202 is cooled of the heat of compression by passage through aftercooler 220 and then passed in stream 203 to auto-refrigerator heat exchanger 230 wherein it is cooled and partially condensed by indirect heat exchange with recirculating refrigerant mixture. Cooled, compressed refrigerant mixture 204 is passed from auto-refrigerator heat exchanger 230 to phase separator 240 wherein it is separated into vapor and liquid phases. The vapor phase portion of the cooled compressed refrigerant mixture is passed in stream 205 from phase separator 240 to turboexpander 250 wherein it is turboexpanded to a pressure generally within the range of from 100 to 1200 psia and thereby generating refrigeration. Resulting two-phase turboexpanded refrigerant fluid 208, which comprises up to 10 percent liquid by mass, is passed to load heat exchanger 170 wherein it is warmed to provide refrigeration to a heat load. The liquid portion of turboexpanded refrigerant mixture 208 may be totally or partially vaporized by the indirect heat exchange with the heat load, and the resulting warmed refrigerant mixture exits load heat exchanger 107 as stream 209.

The liquid phase portion of the cooled compressed refrigerant mixture is passed in stream 206 from phase separator 204 to Joule-Thomson valve 260 wherein it is isenthalpically expanded to generate refrigeration. Resulting refrigerant mixture stream 207, which may be all liquid or in two phases, is passed to auto refrigerator 203, preferably, as shown in FIG. 2, in combination with stream 208 to form stream 212, wherein these fluids are warmed and any liquid vaporized by indirect heat exchange with the previously described cooling compressed refrigerant mixture 203. The resulting warmed refrigerant mixture exits auto-refrigerator heat exchanger 230 as stream 201 for passage to compressor 210 and the turboexpander refrigeration cycle starts anew.

Figure 3:
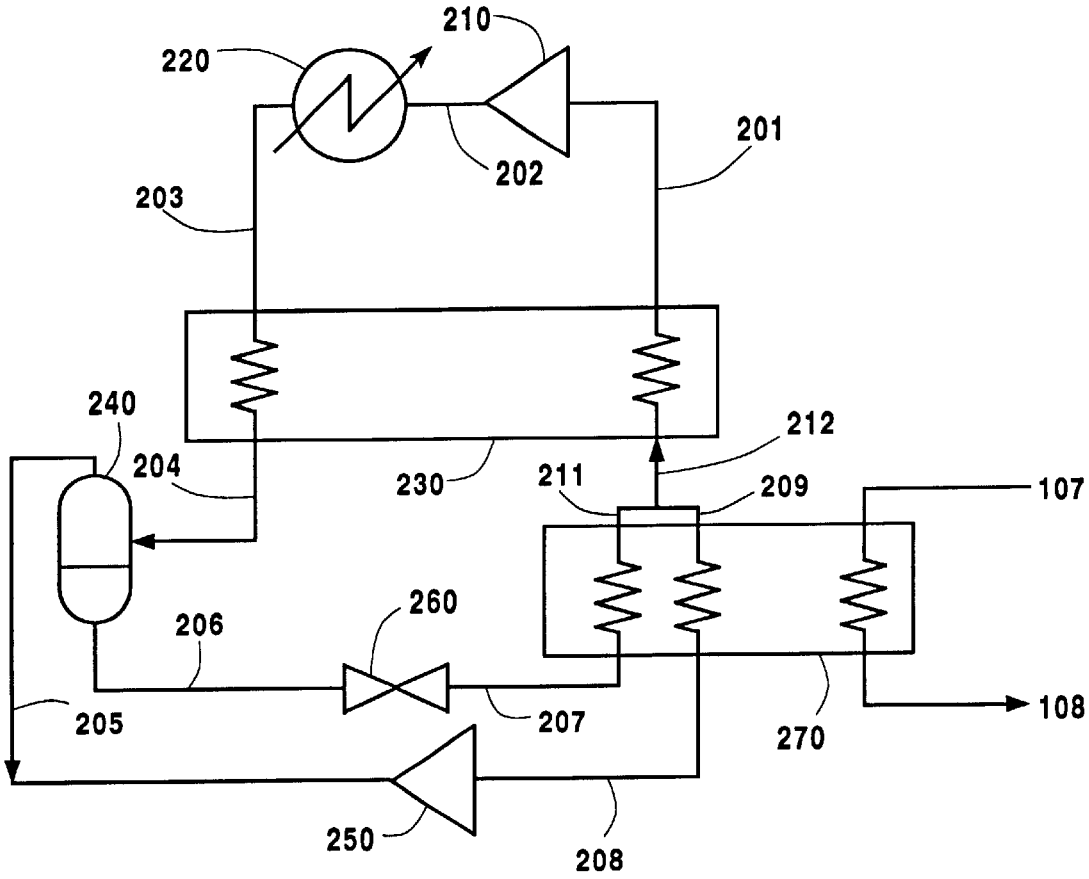
FIG. 3 is a schematic representation of another preferred embodiment similar to the embodiment illustrated in FIG. 2 and additionally employing liquid from the phase separation for providing cooling to the heat load.

FIG. 3 illustrates another embodiment of the invention which is similar to that illustrated in FIG. 2 with the addition of the use of the isenthalpically expanded liquid portion to provide refrigeration to the heat load. The numerals of FIG. 3 correspond to those of FIG. 2 for the common elements and a description of these common elements will not be repeated.

Referring now to FIG. 3, isenthalpically expanded refrigerant mixture 207 is passed to load heat exchanger 270 wherein it is warmed thereby providing refrigeration to the heat load. Resulting refrigerant mixture stream 211 is combined with stream 209 to form stream 212 which is processed as was previously described.

Figure 4:
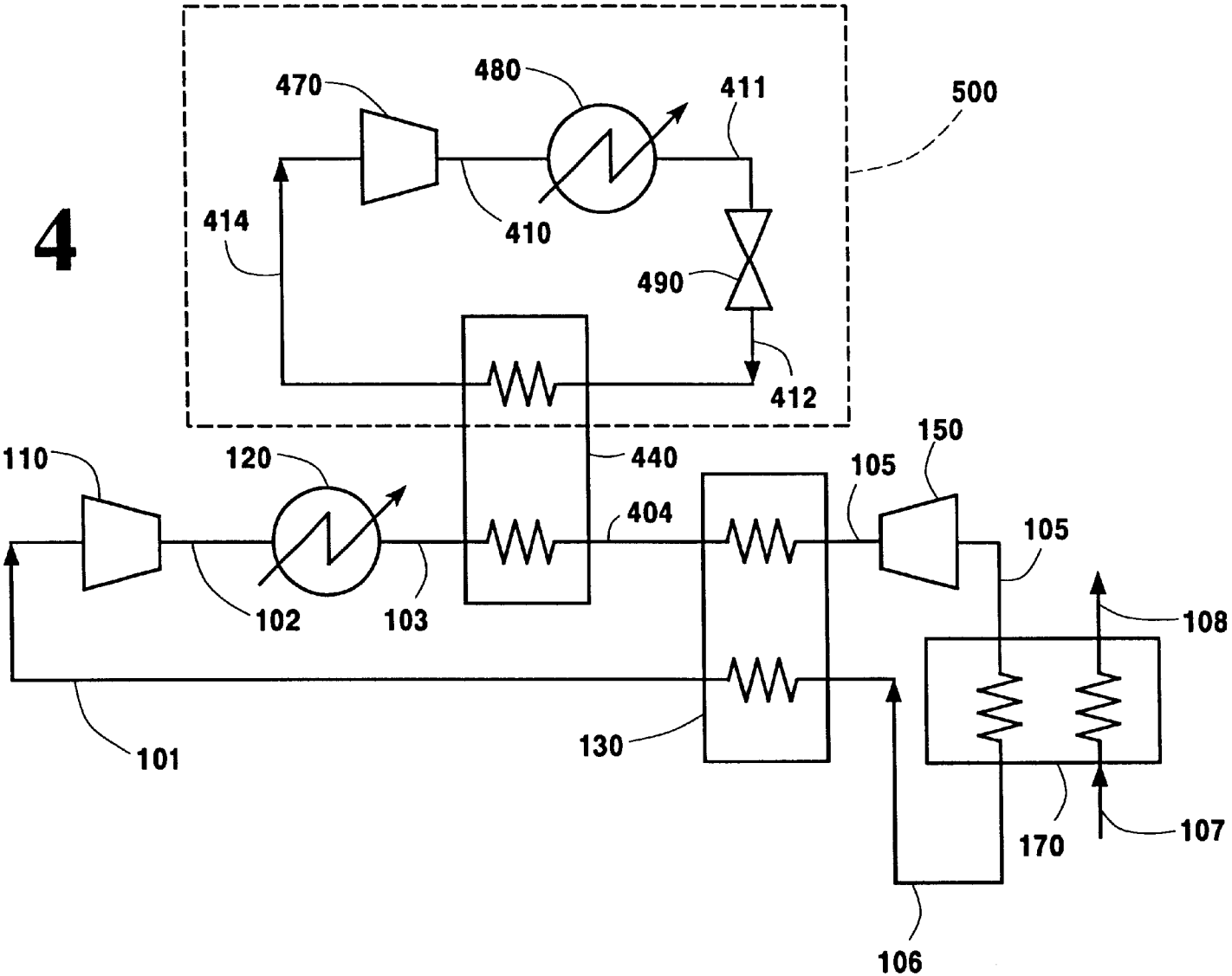
FIG. 4 is a schematic representation of another preferred embodiment of the turboexpander cycle refrigeration method of this invention wherein the refrigerant mixture is precooled using an independent vapor compression refrigeration cycle prior to turboexpansion.

FIG. 4 illustrates another embodiment of the invention wherein the compressed refrigerant mixture is precooled prior to being cooled in the auto-refrigerator heat exchanger. Any effective precooling system may be employed. FIG. 4 illustrates an arrangement employing cascading of two cycles. The numerals of FIG. 4 correspond to those of FIG. 1 for the common elements and these common elements will not be described again in detail.

Referring now to FIG. 4, refrigerant mixture 103 is passed to precooler heat exchanger 440 wherein it is precooled by indirect heat exchange with refrigerant fluid 412 of independent refrigeration system 500. Precooled refrigerant mixture 404 is passed from precooler heat exchanger 440 to auto-refrigerator heat exchanger 130 from which it exits as cooled compressed refrigerant mixture 105 for further processing as was previously described.

The refrigerant fluid used in system 500 may be a single component or multicomponent fluid and may comprise ammonia, one or more hydrocarbons and/or one or more fluorinated compounds. Refrigerant fluid 414 is compressed by passage through compressor 470. Compressed fluid 410 is cooled of the heat of compression in aftercooler 480 and resulting refrigerant fluid 411 is expanded through valve 490 to generate refrigeration. Refrigeration bearing refrigerant fluid 412 is passed to precooler heat exchanger 440 wherein it is warmed and serves to precool compressed refrigerant mixture 103 as was previously described. Resulting warmed refrigerant fluid 414 is passed from precooler heat exchanger 440 to compressor 470 and the independent refrigeration system cycle begins anew.

In Table 1 there are shown the results of four examples of the method of this invention. In Table 1, Examples A, B, and C were carried out using the embodiment of the invention illustrated in FIG. 1, and Example D was carried out using the embodiment of the invention illustrated in FIG. 3. The examples are provided for illustrative purposes and are not intended to be limiting.

TABLE 1

| | A | B | C | D |
|---|---|---|---|---|
| Expander P in (psia) | 1230 | 1400 | 1250 | 1155 |
| Expander P out (psia) | 803 | 929 | 788 | 765 |
| Refrigerant Flow Rate (MCFH) | 1500 | 1500 | 1330 | 1330 |
| Expander Power, kW | 231.1 | 192.7 | 175.6 | 93.4 |
| Compressor Power, kW | 729.3 | 670.8 | 657 | 527.2 |
| Freezer Duty, kW | 351.5 | 351.5 | 351.5 | 351.5 |
| Air Temperature to Freezer (F.) | −80 | −80 | −80 | −80 |
| Air Temperature from Freezer (F.) | −100 | −100 | −100 | −100 |
| Min. Delta T in Freezer (C.) | 2.1 | 2.1 | 2.2 | 2.1 |
| Min. Delta T in Auto-refrigerator (C.) | 2.0 | 2.0 | 2.0 | 2.0 |
| COP | 0.71 | 0.74 | 0.73 | 0.8 |
| Refrigerant Mixture Composition, (mole percent) | | | | |
| Nitrogen | 0 | 0 | 0 | 0 |
| Argon | 93 | 76 | 16 | 64 |
| Tetrafluoromethane | 0 | 24 | 0 | 7 |
| Trifluoromethane | 7 | 0 | 0 | 24 |
| Methane | 0 | 0 | 84 | 0 |
| Pentafluoropropane | 0 | 0 | 0 | 5 |

A conventional turboexpander or reverse Brayton refrigeration circuit using air as the refrigerant fluid has a COP of about 0.67. As can be seen from the results reported in Table 1, the invention provides an improvement in process efficiency over a conventional system of from about 5 to 20 percent.

The invention may be used to achieve ultra low temperatures less than −260° F. and as low as −450° F. In this ultra low temperature embodiment of the invention the refrigerant mixture comprises at least two components with at least one component being helium or neon and at least one component being nitrogen or argon. Other components as in the previously described embodiment may also be present In this ultra low temperature embodiment it would be particularly advantageous for the refrigerant mixture to be precooled independently, such as in the arrangement illustrated in FIG. 4. The independent refrigerant system employed with the ultra low temperature embodiment would preferably precool the refrigerant mixture to a cryogenic temperature and hence will be unlikely to use a single refrigerant vapor compression cycle. A more preferable refrigeration source in this case could be a mixed refrigerant cycle, a conventional reverse brayton cycle such as is used for nitrogen liquefaction, a liquid cryogen such as liquid nitrogen, or a mixed refrigerant reverse brayton cycle cascade system.

Although the invention has been described in detail with reference to certain preferred embodiments, those skilled in the art will recognize that there are other embodiments of the invention within the spirit and the scope of the claims.

What is claimed is:

1. A method for producing refrigeration employing a turboexpander cycle comprising:

(A) compressing a refrigerant mixture comprising at least one component from the group consisting of argon and nitrogen, and at least one component having a normal boiling point within the range of from −100 F. to −260 F.;

(B) cooling the compressed refrigerant mixture;

(C) turboexpanding the cooled compressed refrigerant mixture to provide a two phase turboexpanded refrigerant mixture; and (D) warming the turboexpanded refrigerant mixture to provide refrigeration to a heat load.

2. The method of claim 1 wherein the refrigerant mixture additionally comprises at least one component having a normal boiling point greater than −100 F. up to −20 F.

3. The method of claim 1 wherein the refrigerant mixture additionally comprises at least one component having a normal boiling point greater than −20 F. up to 100 F.

4. The method of claim 1 wherein the warmed turboexpanded refrigerant mixture is further warmed for cooling the compressed refrigerant mixture.

5. The method of claim 1 wherein the cooling of the compressed refrigerant mixture results in partial condensation of the compressed refrigerant mixture into a vapor portion and a liquid portion.

6. The method of claim 5 wherein only the vapor portion of the compressed refrigerant mixture is turboexpanded to provide the two phase turboexpanded refrigerant mixture.

7. The method of claim 5 wherein the liquid portion is isenthalpically expanded and then used to provide refrigeration to the heat load.

8. The method of claim 5 wherein the liquid portion is isenthalpically expanded and then warmed for cooling the compressed refrigerant mixture.

9. The method of claim 1 wherein the compressed refrigerant mixture is precooled prior to the cooling of step (B) by indirect heat exchange with a refrigerant fluid containing refrigeration generated in an independent refrigeration system.

10. The method of claim 1 wherein the refrigerant mixture does not contain any nitrogen.

11. A method for producing refrigeration employing a turboexpander cycle comprising:

(A) compressing a refrigerant mixture comprising at least one component from the group consisting of argon and nitrogen, and at least one component from the group consisting of helium and neon;

(B) cooling the compressed refrigerant mixture;

(C) turboexpanding the cooled compressed refrigerant mixture to provide a two phase turboexpanded refrigerant mixture; and (D) warming the turboexpanded refrigerant mixture to provide refrigeration to a heat load.

12. The method of claim 11 wherein the warmed turboexpanded refrigerant mixture is further warmed for cooling the compressed refrigerant mixture.

13. The method of claim 11 wherein the cooling of the compressed refrigerant mixture results in partial condensation of the compressed refrigerant mixture into a vapor portion and a liquid portion.

14. The method of claim 13 wherein only the vapor portion of the compressed refrigerant mixture is turboexpanded to provide the two phase turboexpanded refrigerant mixture.

15. The method of claim 13 wherein the liquid portion is isenthalpically expanded and then used to provide refrigeration to the heat load.

16. The method of claim 13 wherein the liquid portion is isenthalpically expanded and then warmed for cooling the compressed refrigerant mixture.

17. The method of claim 11 wherein the compressed refrigerant mixture is precooled prior to the cooling of step (B).

18. The method of claim 11 wherein the refrigerant mixture does not contain any nitrogen.

* * * * *